US006991143B1

(12) United States Patent
Gillis

(10) Patent No.: US 6,991,143 B1
(45) Date of Patent: Jan. 31, 2006

(54) ADJUSTABLE DECORATIVE FRAMEWORK SYSTEM

(76) Inventor: Janel R. Gillis, 4496 Harbor Hills Dr., Largo, FL (US) 33770

( * ) Notice: Subject to any disclaimer, the term of this patent is extended or adjusted under 35 U.S.C. 154(b) by 96 days.

(21) Appl. No.: 10/845,655

(22) Filed: May 14, 2004

(51) Int. Cl.
*D06C 15/00* (2006.01)

(52) U.S. Cl. ..... 223/66; 223/68

(58) Field of Classification Search ..... 223/66, 223/68, 69, 84, 120; 434/396
See application file for complete search history.

(56) References Cited

U.S. PATENT DOCUMENTS 526,667 A * 9/1894 Schultz ..... 223/66
1,685,358 A * 9/1928 Harcourt ..... 40/416
5,480,074 A * 1/1996 Duncan et al. ..... 223/66
6,257,467 B1 * 7/2001 Chen ..... 223/66
6,439,952 B1 * 8/2002 Yamamura ..... 446/383
6,601,326 B1 * 8/2003 Bublitz et al. ..... 223/66

* cited by examiner

*Primary Examiner*—Danny Worrell
(74) *Attorney, Agent, or Firm*—Edward P. Dutkiewicz

(57) ABSTRACT

An adjustable decorative framework system has a vertical member with an axis with an upper end, a lower end, and a circular cross sectional configuration with a common diameter over the majority of its axial extent with a semi-cylindrical recess at the central extent and an aperture through the midpoint. A horizontal member has an axis with a first end and a second end having a circular cross sectional configuration with a common diameter equal to the diameter of the vertical member over the majority of its axial extent with a semi-cylindrical recess at the central extent and an aperture through the midpoint. A central bolt and an associated wingnut extend through the aperture of the vertical member and the horizontal member whereby the wing nut may be loosened to vary the angular orientation between the members and tightened to retain the angular orientation between the members.

5 Claims, 3 Drawing Sheets

FIG 1
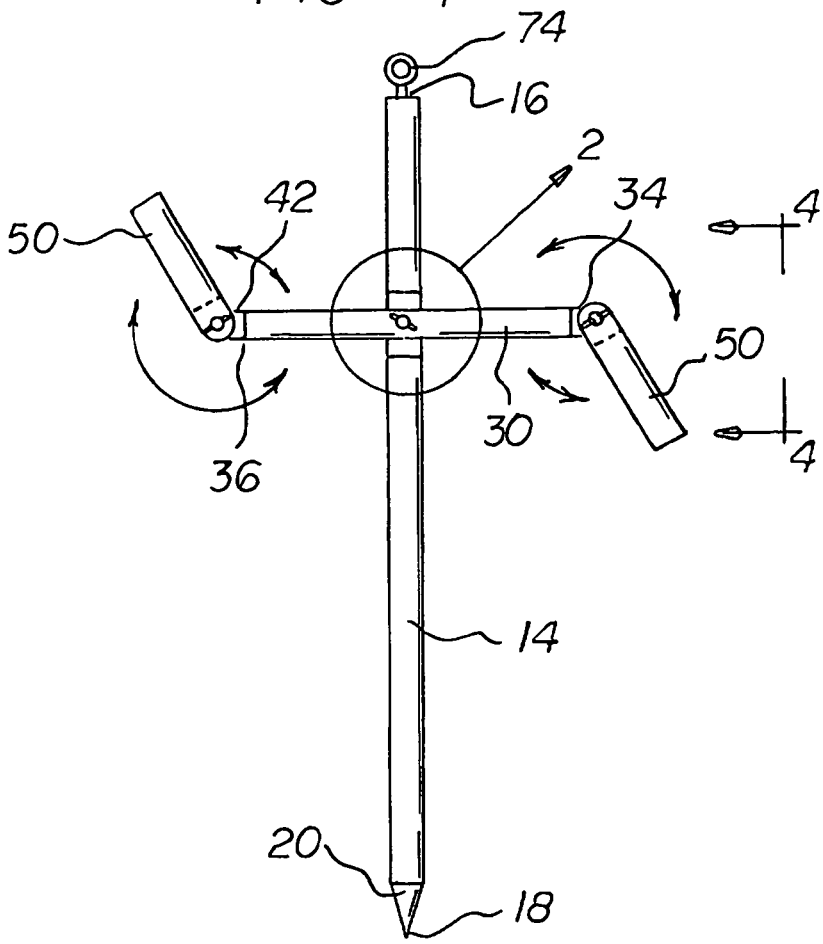
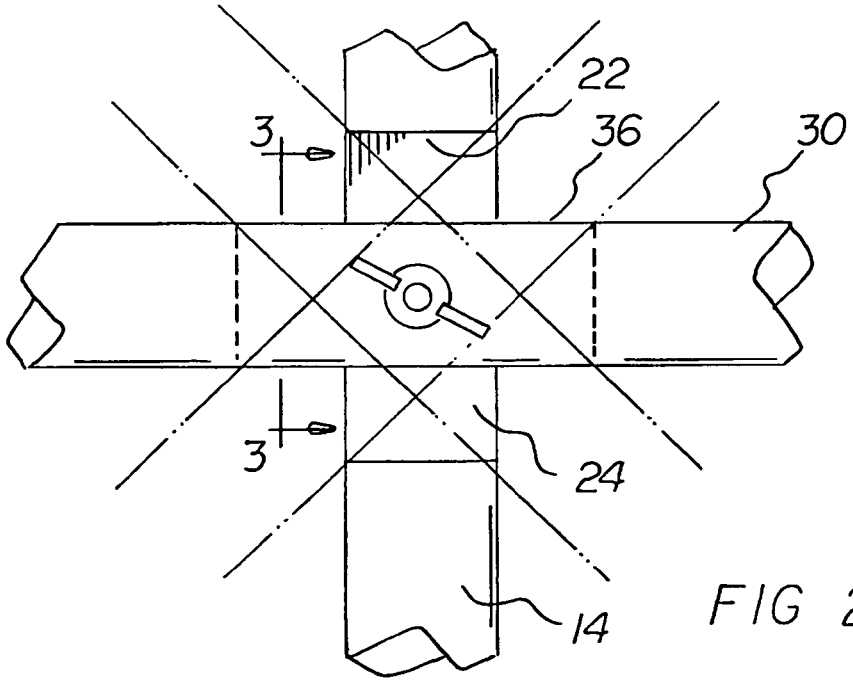
FIG 2

ADJUSTABLE DECORATIVE FRAMEWORK SYSTEM

BACKGROUND OF THE INVENTION

1. Field of the Invention

The present invention relates to an adjustable decorative framework system and more particularly pertains to conveniently repositioning a stick-like mannequin for modeling apparel and for a wide variety of functions.

2. Description of the Prior Art

The use of decorative framework systems of known designs and configurations is known in the prior art. More specifically, decorative framework systems of known designs and configurations previously devised and utilized for the purpose of repositioning mannequins for modeling apparel are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 526,667 issued Sep. 25, 1894 to Schultz discloses a doll. U.S. Pat. No. 5,480,074 issued Jan. 2, 1996 to Duncan discloses a mannequin. U.S. Pat. No. 6,257,467 issued Jul. 10, 2001 to Chen discloses a mobile mannequin. Lastly, U.S. Pat. No. 6,439,952 issued Aug. 27, 2002 to Yamamura discloses a swing posture doll. While these devices fulfill their respective, particular objectives and requirements, the aforementioned patents do not describe an adjustable decorative framework system that allows conveniently repositioning a stick-like mannequin for modeling apparel and for a wide variety of functions.

In this respect, the adjustable decorative framework system according to the present invention substantially departs from the conventional concepts and designs of the prior art, and in doing so provides an apparatus primarily developed for the purpose of conveniently repositioning a stick-like mannequin for modeling apparel and for a wide variety of functions.

Therefore, it can be appreciated that there exists a continuing need for a new and improved adjustable decorative framework system which can be used for conveniently repositioning a stick-like mannequin for modeling apparel and for a wide variety of functions. In this regard, the present invention substantially fulfills this need.

SUMMARY OF THE INVENTION

In view of the foregoing disadvantages inherent in the known types of decorative framework systems of known designs and configurations now present in the prior art, the present invention provides an improved adjustable decorative framework system. As such, the general purpose of the present invention, which will be described subsequently in greater detail, is to provide a new and improved adjustable decorative framework system and method which has all the advantages of the prior art and none of the disadvantages.

To attain this, the present invention essentially comprises an essentially cylindrical vertical member. The vertical member has an axis with an upper end and a lower end and a central extent between the upper and lower ends. The vertical member has a circular cross sectional configuration with a common diameter over the majority of the axial extent. The vertical member has a cone shaped region at the lower end and a semi-cylindrical recess at the central extent closer to the upper end than the lower end. The recess forms a front facing flat having an axial length greater than the diameter of the vertical member. An aperture is provided through a midpoint of the front facing flat.

Next provided is an essentially cylindrical horizontal member. The horizontal member has an axis with a first end and a second end with a central extent midway between the first and second ends. The horizontal member has a circular cross sectional configuration with a common diameter equal to the diameter of the vertical member over the majority of its axial extent. The horizontal member also has a semi-cylindrical recess at the central extent. The semi-cylindrical recess forms a back facing flat. The semi-cylindrical recess has an axial length greater than the diameter of the horizontal member. An aperture is provided through the midpoint of the front facing flat. The horizontal member also has a semi-cylindrical end recess at each end of the horizontal member forming a front facing flat. Each end recess has an axial length greater than the diameter of the horizontal member and an aperture through midpoints of the front facing flats of each end recess.

Next provided is a pair of similarly configured essentially cylindrical extension members having an axis with an exterior end and an interior end. Each extension member has a circular cross sectional configuration with a common diameter equal to the diameter of the horizontal member over the majority of its axial extent. Each extension member also has a semi-cylindrical recess at each interior end forming a back facing flat. Each recess has an axial length greater than the diameter of each extension member and an aperture through the midpoint of each flat.

Next, a central bolt and an associated wingnut are provided. The central bolt extends through the aperture of the vertical member and the central aperture of the horizontal member with the flat of the vertical member in contact with the central flat of the horizontal member. A pair of end bolts and an associated wingnut are provided for each end bolt. Each end bolt extends through an end aperture of the horizontal member and the aperture of each extension member with the end flats of the horizontal member in contact with the flats of the extension members. In this manner, the various wing nuts may be loosened to vary the angular orientation between the various members and tightened to retain the angular orientation between the various members.

Next, an eye bolt is provided. The eye bolt is threadedly coupled to the upper end of the vertical member for suspending the system.

Lastly, a pedestal with legs is provided. The pedestal and legs function to receive and support the system upon a floor. The pedestal has an upwardly extending hollow post. The post has a circular opening for receiving the cone-shaped region of the vertical member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable decorative framework system which has all of the advantages of the prior art decorative framework systems of known designs and configurations and none of the disadvantages.

It is another object of the present invention to provide a new and improved adjustable decorative framework system which may be easily and efficiently manufactured and marketed.

It is further object of the present invention to provide a new and improved adjustable decorative framework system which is of durable and reliable constructions.

An even further object of the present invention is to provide a new and improved adjustable decorative framework system which is susceptible of a low cost of manufacture with regard to both materials and labor, and which accordingly is then susceptible of low prices of sale to the consuming public, thereby making such adjustable decorative framework system economically available to the buying public.

Even still another object of the present invention is to provide an adjustable decorative framework system for conveniently repositioning a stick-like mannequin for modeling apparel and for a wide variety of functions.

Lastly, it is an object of the present invention to provide a new and improved An adjustable decorative framework system has a vertical member with an axis with an upper end, a lower end, and a circular cross sectional configuration with a common diameter over the majority of its axial extent with a semi-cylindrical recess at the central extent and an aperture through the midpoint. A horizontal member has an axis with a first end and a second end having a circular cross sectional configuration with a common diameter equal to the diameter of the vertical member over the majority of its axial extent with a semi-cylindrical recess at the central extent and an aperture through the midpoint. A central bolt and an associated wingnut extend through the aperture of the vertical member and the horizontal member whereby the wing nut may be loosened to vary the angular orientation between the members and tightened to retain the angular orientation between the members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an adjustable decorative framework system constructed in accordance with the principles of the present invention.

FIG. 2 is an enlarged front elevational view of the central region of the system taken at circle 2 of FIG. 1.

The same reference numerals refer to the same parts throughout the various Figures.

DESCRIPTION OF THE PREFERRED EMBODIMENT

Figure 3:
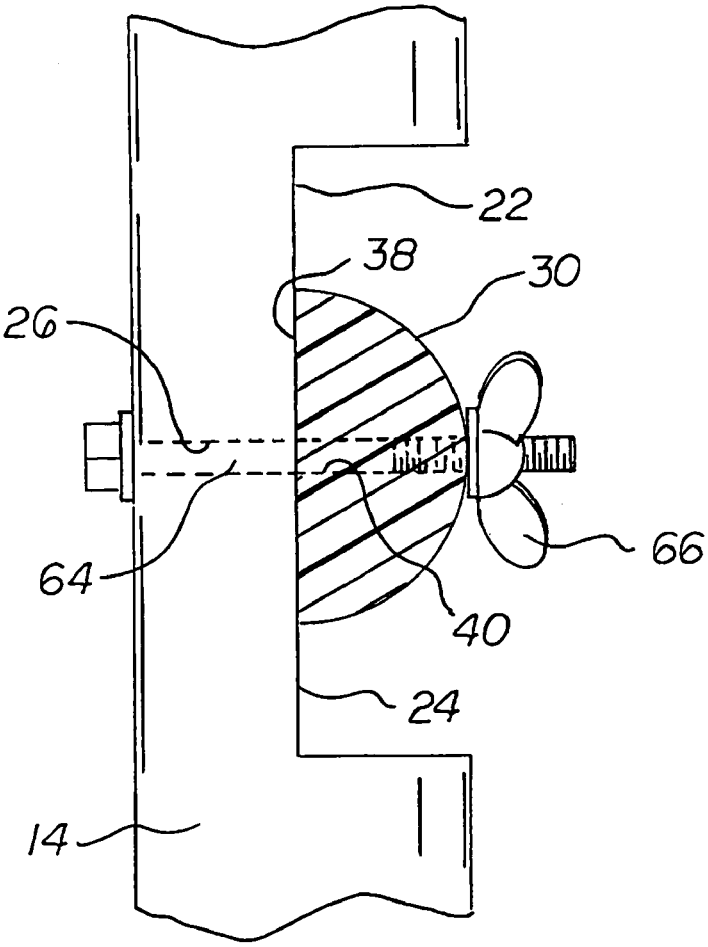
FIG. 3 is a cross sectional view taken at line 3—3 of FIG. 2.

With reference now to the drawings, and in particular to FIG. 1 thereof, the preferred embodiment of the new and improved adjustable decorative framework system embodying the principles and concepts of the present invention and generally designated by the reference numeral 10 will be described.

The present invention, the adjustable decorative framework system 10 is comprised of a plurality of components. Such components in their broadest context include a X, a X, a X and a X . . . . Such components are individually configured and correlated with respect to each other so as to attain the desired objective.

First provided is an essentially cylindrical vertical member 14. The vertical member has an axis with an upper end 16 and a lower end 18 and a central extent between the upper and lower ends. The vertical member has a circular cross sectional configuration with a common diameter over the majority of the axial extent. The vertical member has a cone shaped region 20 at the lower end and a semi-cylindrical recess 22 at the central extent closer to the upper end than the lower end. The recess forms a front facing flat 24 having an axial length greater than the diameter of the vertical member. An aperture 26 is provided through a midpoint of the front facing flat.

Next provided is an essentially cylindrical horizontal member 30. The horizontal member has an axis with a first end 32 and a second end 34 with a central extent midway between the first and second ends. The horizontal member has a circular cross sectional configuration with a common diameter equal to the diameter of the vertical member over the majority of its axial extent. The horizontal member also has a semi-cylindrical recess 36 at the central extent. The semi-cylindrical recess forms a back facing flat 38. The semi-cylindrical recess has an axial length greater than the diameter of the horizontal member. An aperture 40 is provided through the midpoint of the front facing flat. The horizontal member also has a semi-cylindrical end recess 42 at each end of the horizontal member forming a front facing flat 44. Each end recess has an axial length greater than the diameter of the horizontal member and an aperture 46 through midpoints of the front facing flats of each end recess.

Next provided is a pair of similarly configured essentially cylindrical extension members 50 having an axis with an exterior end 52 and an interior end 54. Each extension member has a circular cross sectional configuration with a common diameter equal to the diameter of the horizontal member over the majority of its axial extent. Each extension member also has a semi-cylindrical recess 56 at each interior end forming a back facing flat 58. Each recess has an axial length greater than the diameter of each extension member and an aperture 60 through the midpoint of each flat.

Figure 4:
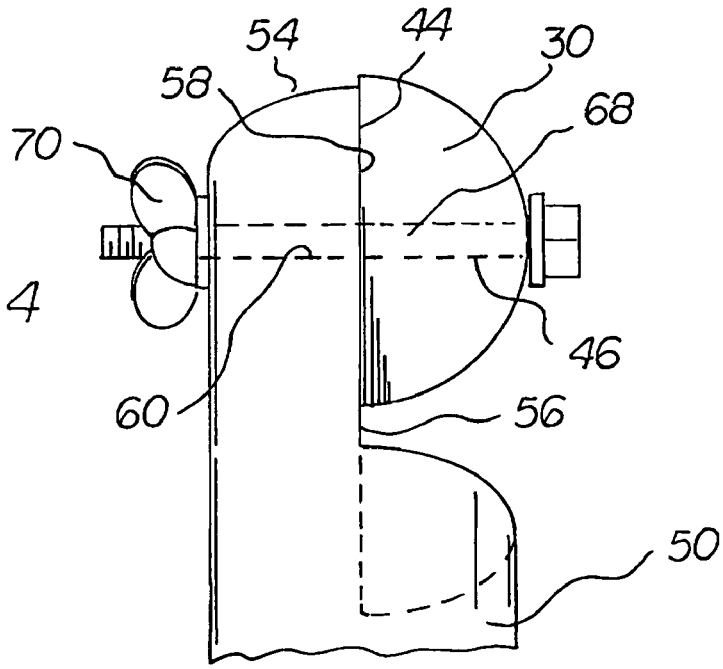
FIG. 4 is a cross sectional view taken at line 4—4 of FIG. 1.
Figure 5:
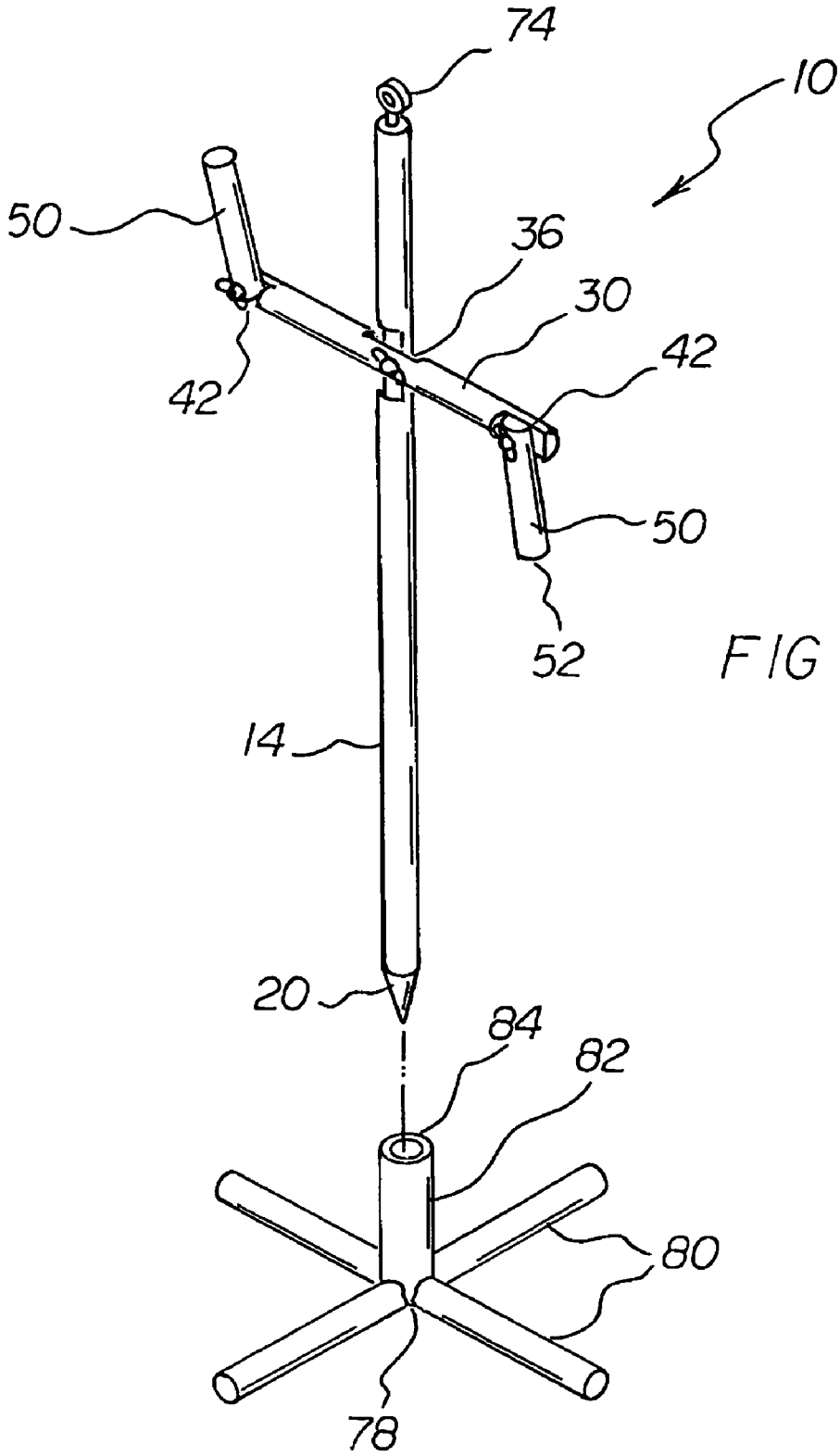
FIG. 5 is an exploded perspective illustration of the system of the prior Figures.

Next, a central bolt 64 and an associated wingnut 66 are provided. The central bolt extends through the aperture of the vertical member and the central aperture of the horizontal member with the flat of the vertical member in contact with the central flat of the horizontal member. A pair of end bolts 68 and an associated wingnut 70 are provided for each end bolt. Each end bolt extends through an end aperture of the horizontal member and the aperture of each extension member with the end flats of the horizontal member in contact with the flats of the extension members. In this manner, the various wing nuts may be loosened to vary the angular orientation between the various members and tightened to retain the angular orientation between the various members. Note the dotted lines of FIGS. 2 and 4 which illustrate alternate orientations of the various members.

Next, an eye bolt 74 is provided. The eye bolt is threadedly coupled to the upper end of the vertical member for suspending the system.

Lastly, a pedestal 78 with legs 80 is provided. The pedestal and legs function to receive and support the system upon a floor. The pedestal has an upwardly extending hollow post 82. The post has a circular opening 84 for receiving the cone-shaped region of the vertical member.

The present invention is readily adapted for indoor and/or outdoor use. When used indoors, it is preferably supported by the stand. When used outdoors, it is preferably supported by insertion into the soil, grass, a hay bale, or the like. For indoor use, the system is preferably about six feet tall. For outdoor use, the system is preferably about eight feet tall, extending into the supporting material for about two feet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable decorative framework system for the convenient repositioning of a stick-like mannequin for modeling apparel and for a wide variety of functions comprising, in combination:

an essentially cylindrical vertical member having an axis with an upper end and a lower end with a central extent there between, the vertical member having a circular cross sectional configuration with a common diameter over the majority of its axial extent, the vertical member also having a cone shaped region at the lower end a semi-cylindrical recess at the central extent closer to the upper end than the lower end with the recess forming a front facing flat having an axial length greater than the diameter of the vertical member and an aperture through the midpoint of the front facing flat;

an essentially cylindrical horizontal member having an axis with a first end and a second end with a central extent midway there between, the horizontal member having a circular cross sectional configuration with a common diameter equal to the diameter of the vertical member over the majority of its axial extent, the horizontal member also having a semi-cylindrical recess at the central extent forming a back facing flat with the recess having an axial length greater than the diameter of the horizontal member and an aperture through the midpoint of the front facing flat, the horizontal member also having a semi-cylindrical end recess at each end of the horizontal member forming a front facing flat with each end recess having an axial length greater than the diameter of the horizontal member and an aperture through the midpoints of the front facing flats of each end recess;

a pair of similarly configured essentially cylindrical extension members having an axis with an exterior end and an interior end, each extension member having a circular cross sectional configuration with a common diameter equal to the diameter of the horizontal member over the majority of its axial extent, each extension member also having a semi-cylindrical recess at each interior end forming a back facing flat with each recess having an axial length greater than the diameter of each extension member and an aperture through the midpoint of each flat;

a central bolt and an associated wingnut, the central bolt extending through the aperture of the vertical member and the central aperture of the horizontal member with the flat of the vertical member in contact with the central flat of the horizontal member, a pair of end bolts and an associated wingnut for each end bolt, each end bolt extending through an end aperture of the horizontal member and the aperture of each extension member with the end flats of the horizontal member in contact with the flats of the extension members whereby the various wing nuts may be loosened to vary the angular orientation between the various members and tightened to retain the angular orientation between the various members;

an eye bolt threadedly coupled to the upper end of the vertical member for suspending the system; and a pedestal with legs whereby the system may be received and supported upon a floor, the pedestal having an upwardly extending hollow post having a circular opening for receiving the cone shaped region of the vertical member.

2. An adjustable decorative framework system comprising:

a vertical member having an axis with an upper end and a lower end having a circular cross sectional configuration with a common diameter over the majority of its axial extent with a semi-cylindrical recess at the central extent and an aperture through the midpoint;

a horizontal member having an axis with a first end and a second end having a circular cross sectional configuration with a common diameter equal to the diameter of the vertical member over the majority of its axial extent with a semi-cylindrical recess at the central extent and an aperture through the midpoint; and a central bolt and an associated wingnut extending through the aperture of the vertical member and the horizontal member whereby the wing nut may be loosened to vary the angular orientation between the members and tightened to retain the angular orientation between the members.

3. The system as set forth in claim 2 and further including:

a pair of similarly configured essentially cylindrical extension members having an axis and with an exterior end and an interior end, each extension member having a circular cross sectional configuration with a common diameter equal to the diameter of the horizontal member over the majority of its axial extent, each extension member also having a semi-cylindrical recess at each interior end and an aperture through the midpoint of each flat; and a pair of end bolts and an associated wingnut for each end bolt, each end bolt extending through an end aperture of the horizontal member and the aperture of each extension member whereby the various wing nuts may be loosened to vary the angular orientation between the various members.

4. The system as set forth in claim 2 and further including:

an eye bolt threadedly coupled to the upper end of the vertical member for suspending the system.

5. The system as set forth in claim 2 and further including:

a pedestal with legs whereby the system may be received and supported upon a floor, the pedestal having an upwardly extending hollow post having a circular opening for receiving the lower end of the vertical member.

* * * * *